United States Patent [19]

Dorsen et al.

[11] 4,294,299

[45] Oct. 13, 1981

[54] HANDBAG CONSTRUCTION

[75] Inventors: Mac Dorsen, Scarsdale; Philip A. Saltzman, Brooklyn, both of N.Y.

[73] Assignee: Stupell Industries, Ltd., Johnston, R.I.

[21] Appl. No.: 120,936

[22] Filed: Feb. 12, 1980

[51] Int. Cl.[3] ..... A45C 3/06

[52] U.S. Cl. ..... 150/28 R; 150/46; 220/4 E; 220/343

[58] Field of Search ..... 150/28 R, 46; 220/4 E, 220/4 B, 343, 340, 338

[56] References Cited

U.S. PATENT DOCUMENTS

| | | | |
|---|---|---|---|
| 2,518,572 | 8/1950 | Sanders | 150/46 X |
| 2,522,549 | 9/1950 | Waggoner | 150/28 R |
| 3,373,892 | 3/1968 | Landen | 220/343 |
| 4,187,639 | 2/1980 | Ono | 220/4 E X |

FOREIGN PATENT DOCUMENTS

| | | | |
|---|---|---|---|
| 1525348 | 4/1968 | France | 220/338 |

*Primary Examiner*—Donald F. Norton
*Attorney, Agent, or Firm*—Salter & Michaelson

[57] ABSTRACT

An essentially two piece case such as a handbag which is adapted to move between a closed and a limited open position. The case includes two shells of identical construction and each including hinge portions which when interengaged form the overall construction. Each shell includes a pair of opposed generally planar fixed end walls, which end walls are adapted for overlapping slidable relationship with respect to each other when the shells are interengaged.

9 Claims, 8 Drawing Figures

HANDBAG CONSTRUCTION

BACKGROUND AND SUMMARY OF THE INVENTION

This invention relates to a case structure and more particularly to a novel and improved construction for a handbag and the like. Handbags and other case structures which include opposed sidewall halves or shells which cooperate in opposed relationship to each other and are connected along a bottom hinge line so as to move between open and closed pivotal positions are generally known.

However, such known handbag construction usually include connecting end walls in the form of accordion-like gussets which enable the sidewall halves or shells to move relative to each other yet still provide for the substantial enclosure of articles within the case. Such gussets are normally formed from a flexible material such as fabric leather and the like and accordingly present some difficulty in attaining such material to the sidewall shells. They are furthermore subject to considerable wear especially along the pleats or fold lines formed either in the initial gusset construction or through use. It would accordingly be desirable to be able to avoid gusset type end panels in such handbag constructions and yet still have a handbag which defines a complete enclosure and which has opposed side portions which move pivotally between open and closed portions.

It is accordingly a primary object of the present invention to provide a handbag construction which eliminates presently utilized gusseted end wall panels and yet which is fully functional and of attractive styling.

A further object of the present invention is a provision of a handbag construction of the aforementioned type which further is formed from identical shell halves such that said shells can be formed by conventional molding procedures and yet require but a single mold so as to present a cost advantage over constructions using similar but different components.

These and other objects of the present invention are accomplished by a case adapted for movement between open and closed positions, such as a handbag and the like, and which is formed from a pair of identical concave shells disposed in opposed position to one another and connected along hinge means provided at a lower end thereof. Each of the shells are provided at opposite ends with end walls corresponding in planar configuration to that of the end configuration of the case when disposed in its closed position. When the two shells are disposed in opposition to each other and are hingedly interconnected, the end walls of each are adapted for overlapping slidable relationship to one another so as to enable the opening and closing of the resultant handbag construction in the desired manner.

Other objects, features and advantages of the invention will become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
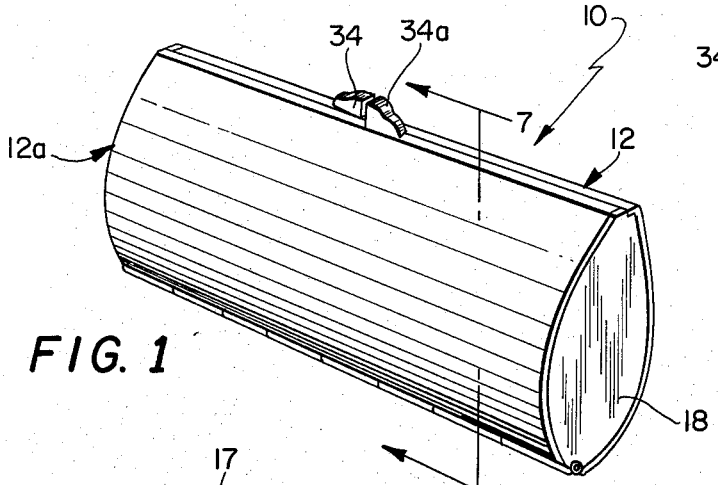
FIG. 1 is a perspective view of a handbag in its closed position and illustrating features of the present invention.
Figure 3:
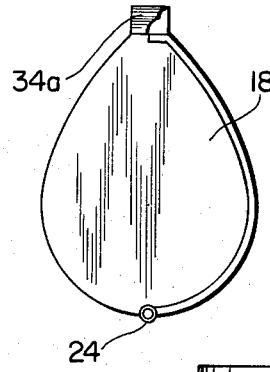
FIG. 3 is an end view of the handbag taken from the right hand side of FIG. 1.

Turning now to the drawing, it may be apparent that the completed handbag construction 10 of the present invention is formed from two identically constructed halves or shells 12. Each shell 12 includes a body 14 of curved configuration so as to form a concave interior portion. Opposite ends of the body are provided with upstanding parallel end walls 16 and 18. The body 14 further includes a terminal upper edge 20 and a terminal lower edge 22 which extend between the opposite end walls 16 and 18. In addition, end wall 16 terminates in an outer edge surface 17 and end wall 18 includes an outer edge surface 19. Generally each shell 12 is of integral construction and may be formed by known techniques including the injection molding of plastic resins such as polystyrene, polyethylene and the like.

The lower edge 22 of each of the shells 12 are provided with hinge means in the form of a plurality of longitudinally spaced hinge barrels 24. Such barrels are of cylindrical form, that is, have an opening or bore 26 provided therethrough so as to form a central hinge line therethrough. The end wall 16 is provided with an upwardly extending curved cut-out 28 at the base thereof while the other end wall 18 either includes a similar cut-out or its adjacent barrel 24 provides an opening therethrough dependent on whether or not the barrels 24 are formed integral with the shells or later attached thereto by known means such as adhesive connection, sonic welding or the like. Two of such identical shells, namely shells 12 and **12*a*, when disposed in opposed relationship and interconnected by means of a hinge rod or pin 30 extending through the aligned openings 26 of adjacent barrels 24 and 24*a* serve to form the completed handbag construction 10**.

Figure 4:
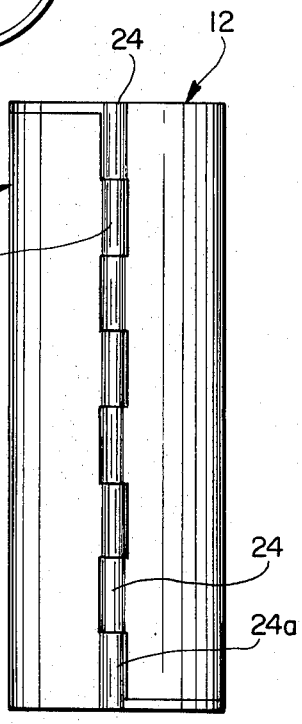
FIG. 4 is a bottom plan view of FIG. 1.

The relationship of the shells 12 and **12*a* is such that the shell 12*a* has been turned 180° and disposed in face to face relationship with the shell 12. Accordingly, 18 and 18*a* are disposed at opposite ends of the completed handbag structure. In this regard, the end walls 16 and 18 of shell 12 are adapted to overlap end walls 18*a* and 16*a* of shell 12*a* respectively in pivotal slidable relationship thereto. Also in this regard it should be clear that the barrel 24*a* adjacent end wall 18*a* will be disposed in the cut-out 28 of end wall 16 and that furthermore the barrels 24 and 24*a* are configured such that they interengage in longitudinally oriented abutting relationship, as best shown in FIG. 4. When the shells 12 and 12*a* are so disposed, the hinge pin 30, which may be simply a plastic or steel rod, is pushed through the aligned openings 26** and thus secures the shells together.

Figure 7:
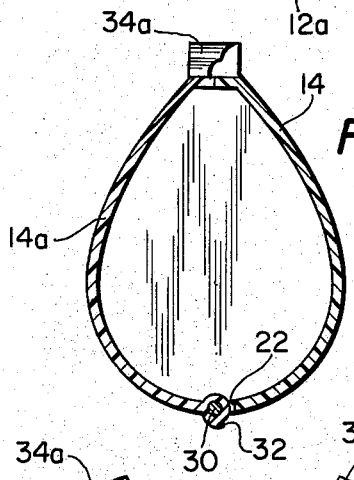
FIG. 7 is a sectional view taken along the line 7—7 of FIG. 1.
Figure 6:
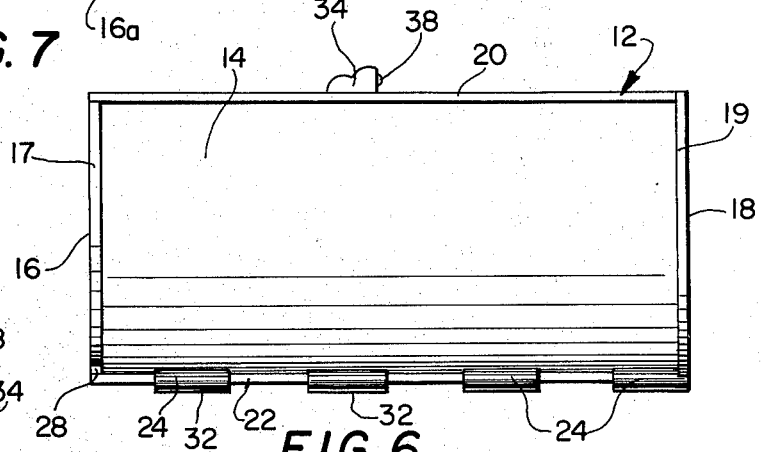
FIG. 6 is a side elevational view of one of the essentially identical component halves of the present handbag construction.
Figure 8:
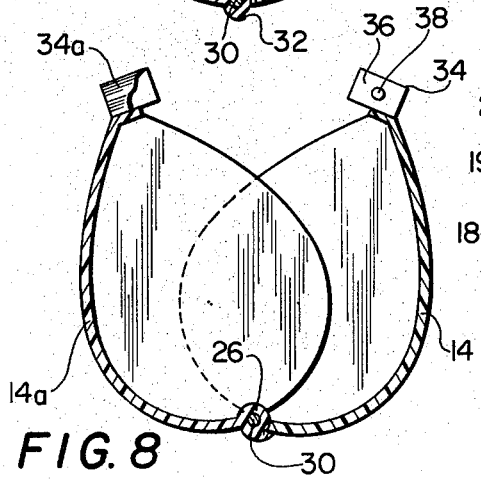
FIG. 8 is a sectional view similar to FIG. 7 but showing the handbag in its open position such as illustrated in FIG. 2.
Figure 5:
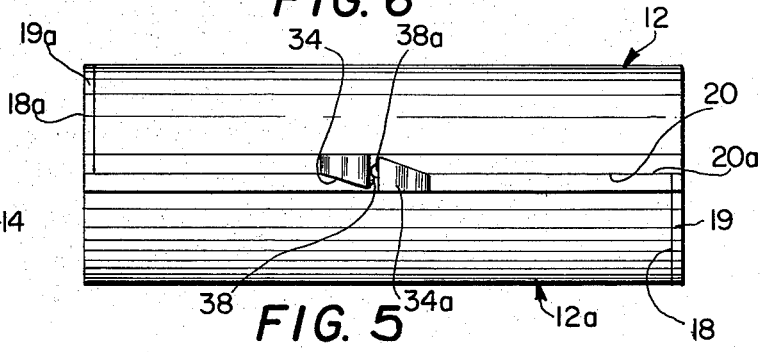
FIG. 5 is a top plan view thereof.

Generally, it is desirable that the pivotal movement of the shells with respect to each other be limited. In this regard each of the barrels 24 are provided with a radially extending shoulder 32 including a relatively flat face such that the shoulder face contacts the lower edge 22 of the opposite shell body or outer portions of the opposite shell body adjacent the lower edge 22 thereof as may be seen by particular reference to FIGS. 7 and 8. In addition, each of the shells 12 and 12*a* is provided with an upstanding snap lock means including an extension 34 having a relatively straight surface 36 in turn provided with an outwardly extending bead 38. The locking action between the shell halves 12 and 12*a* is brought about, as best shown in FIG. 5, when the respective beads 38 and 38*a* frictionally snap past each other. When in such closed position, the outer edge surface 17 of the end wall 16 is adapted to abut the inner concave surface of the body 14*a* in substantial line contact adjacent the end wall 18*a* while the corresponding edge surface 17*a* of shell 12*a* contacts a similar portion of the shell 12. Such interaction between edges 17 and 17*a* and their respective shell surfaces establishes a further positive stop in addition to that provided by the coaction of the top edge surfaces 20 and 20*a* in the closed position of handbag 10.

As will be noted, the snap locks 34 and 34*a* are of identical configuration whereby they may if desired, be integrally molded as a part of their resepective shell still using the same mold to form the complete shells 12 and 12*a*.

The above-described handbag construction not only removes the need for gusseted end panel constructions but further enables an attractive, stylish and relatively low cost bag to be constructed from identical component halves. The resultant construction is also considerably sturdier than prior art constructions inasmuch as the adjacent and overlapping positioning of the end panels with respect to each other prevents longitudinal movement of the shell halves with respect to each other in both the open and closed position of the handbag, in addition to the abutting relationship of the hinge means. Also, formation of each end panel in the completed cross-sectional configuration of the assembled handbag enables the aforementioned abutting relationship of the end panel outer edges with respect to its opposed shell half such that the halves may not be undesirably telescoped with regard to each other should the lock means be broken or the hinge means misaligned.

Figure 2:
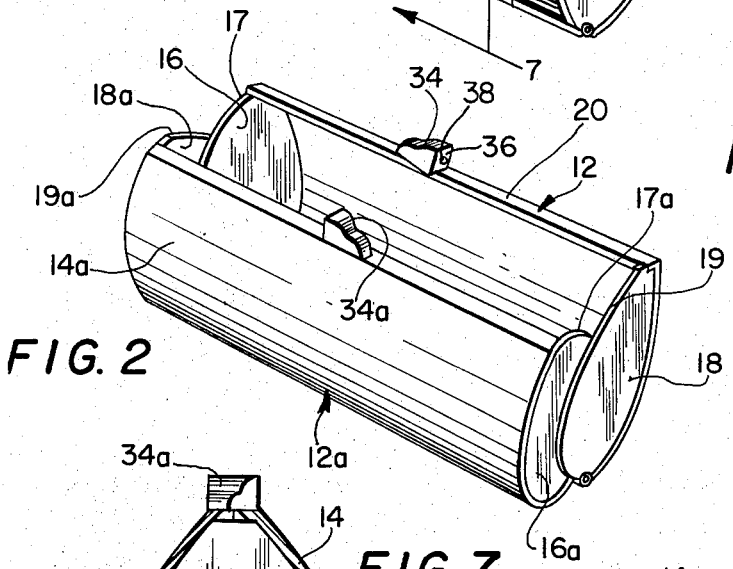
FIG. 2 is a similar view but showing the handbag in its open position.

Since the shells 12 and 12*a* are made from the same mold, it will be obvious, as shown most clearly in FIG. 2, that end wall 16*a* will be positioned inwardly of adjacent end wall 18 while end 16 will be positioned inwardly of adjacent end wall 18*a*, or vice versa. Also the configuration of the end walls is such that even when the case is opened to its fullest extent as shown in FIG. 2, the ends of the case remain substantially enclosed, much like a case having gusseted end walls.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A case adapted for movement between open and closed positions, such as a handbag and the like, comprising a pair of identically configured shells, each said shell including an open inwardly concave body having first and second opposed parallel upright end walls inwardly extending therefrom and further terminating in upper and lower edges extending between said end walls, each of said end walls having a face essentially corresponding in planar configuration to that of the end configuration of the case when disposed in its closed position, said lower edges including inwardly extending hinge means defining a longitudinal hinge line, said shells adapted for connection with each other along said hinge line with said concave shell bodies opposed and pivotable away from and towards each other about said hinge line between said open and closed case positions, respectively, with the first end wall of one shell and the second end wall of the other shell overlapped in slidable, generally face to face contacting relationship with the first end wall of said one shell disposed inwardly of the second end wall of the other shell at one end of the case and the second end wall of said one shell disposed outwardly of the first end wall of the other shell at the other case end.

2. The case construction of claim 1 wherein the inwardly directed terminal edge of the first end walls of said one and said other shell abut the concave body of said other and said one shell, respectively, in said closed case position.

3. The case construction of claim 2, said end walls of a regular geometric shape and said inwardly directed edges thereof defining a curve complementary to the body curve defined along a normal cross-section thereof.

4. The case construction of claim 3, said end walls being of tear drop configuration.

5. The case construction of claim 4, said hinge means including at least two generally cylindrical hinge barrels inwardly projecting and longitudinally aligned and spaced along said shell body lower edge, the barrels of one shell adapted to interfit with the barrels of the other shell in aligned relationship along said hinge line, and pin means adapted for dispostion through said aligned barrels so as to join said case shells together, said hinge means further including pivotal motion limiting means comprising a longitudinally oriented shoulder radially extending from the surface of at least one of said barrels, said shoulder adapted to abut that portion of said opposed shell body adjacent the lower edge thereof in said assembled and open case position.

6. The case construction of claim 2, said hinge means including at least two generally cylindrical hinge barrels inwardly projecting and longitudinally aligned and spaced along said shell body lower edge, the barrels of one shell adapted to interfit with the barrels of the other shell in aligned relationship along said hinge line, and pin means adapted for disposition through said aligned barrels so as to join said case shells together.

7. The case construction of claim 1, said hinge means includes at least two generally cylindrical hinge barrels inwardly projecting and longitudinally aligned and spaced along said shell body lower edge, the barrels of one shell adapted to interfit with the barrels of the other shell in aligned relationship along said hinge line, and pin means adapted for disposition through said aligned barrels so as to join said case shells together.

8. The case construction of claim 7, said hinge means including pivotal motion limiting means comprising a longitudinally oriented shoulder radially extending from the surface of at least one of said barrels, said shoulder adapted to abut that portion of said opposed shell body adjacent the lower edge thereof in said assembled and open case position.

9. The case construction of claims 8 or 5, said first end wall having an upwardly directed curved notch at the bottom thereof and adjacent said lower edge, one of said barrels positioned adjacent said second end wall such that said one barrel of each shell is positioned in said notch of the opposed shell.

* * * * *